US005222729A

United States Patent [19]

Wallaschkowski

[11] Patent Number: 5,222,729

[45] Date of Patent: Jun. 29, 1993

[54] METHOD AND APPARATUS FOR DETECTING SUPERIMPOSED SHEETS OF PAPER

[75] Inventor: Horst H. Wallaschkowski, Wurzburg, Fed. Rep. of Germany

[73] Assignee: Koenig & Bauer Aktiengesellschaft, Fed. Rep. of Germany

[21] Appl. No.: 809,510

[22] PCT Filed: Mar. 12, 1991

[86] PCT No.: PCT/DE91/00212

§ 371 Date: Jan. 15, 1992

§ 102(e) Date: Jan. 15, 1992

[87] PCT Pub. No.: WO91/14997

PCT Pub. Date: Oct. 3, 1991

[30] Foreign Application Priority Data

Mar. 17, 1990 [DE] Fed. Rep. of Germany ..... 4008600

[51] Int. Cl.[5] ..... B65H 7/12

[52] U.S. Cl. ..... 271/262; 250/223 R; 356/384; 356/394

[58] Field of Search ..... 271/262, 263; 250/223 R; 356/1, 384, 394, 381

[56] References Cited

U.S. PATENT DOCUMENTS

| | | | |
|---|---|---|---|
| 3,186,708 | 6/1965 | Hinz | 271/263 |
| 3,278,754 | 10/1966 | Wallace | 271/263 |
| 3,565,531 | 2/1971 | Kane et al. . | |
| 3,671,726 | 6/1972 | Kerr | 235/151.3 |
| 4,286,149 | 8/1981 | Ben-Nathan et al. | 250/223 R |
| 4,397,460 | 8/1983 | Milanes et al. . | |
| 4,773,760 | 9/1988 | Makkonen | 356/381 |
| 4,937,460 | 6/1990 | Duncan et al. | 271/263 |

FOREIGN PATENT DOCUMENTS

| | | | |
|---|---|---|---|
| 0332781 | 11/1988 | European Pat. Off. . | |
| 3642377 | 11/1986 | Fed. Rep. of Germany . | |
| 53-27448 | 3/1978 | Japan . | |
| 53-27449 | 3/1978 | Japan . | |
| 184041 | 11/1982 | Japan | 271/263 |
| 78935 | 5/1983 | Japan | 271/263 |
| 216851 | 12/1983 | Japan | 271/262 |
| 156958 | 7/1987 | Japan | 271/262 |
| 63-30708 | 9/1988 | Japan . | |
| WO8102628 | 9/1981 | World Int. Prop. O. . | |

OTHER PUBLICATIONS

Opticator-Systembeschreibung, Published 1980.

*Primary Examiner*—Robert P. Olszewski
*Assistant Examiner*—Steven M. Reiss
*Attorney, Agent, or Firm*—Jones, Tullar & Cooper

[57] ABSTRACT

A method and apparatus for detecting superimposed sheets of paper in a sheet fed printing press utilizes cooperating upper and lower transmitter and receiver pairs that are positioned above and below the sheet transport path. Voltages that are representative of the positions of the upper and lower surfaces of the sheet are compared to nominal values. If the actual values significantly exeed the nominal values, a superimposed sheet condition exists and appropriate corrective action can be taken.

2 Claims, 4 Drawing Sheets

METHOD AND APPARATUS FOR DETECTING SUPERIMPOSED SHEETS OF PAPER

FIELD OF THE INVENTION

The present invention is directed generally to a method and apparatus for detecting superimposed sheets of paper. More particularly, the present invention is directed to a method and apparatus for detecting superimposed sheets of paper in a sheet transport path. Most specifically, the present invention is directed to a method and apparatus for detecting superimposed sheets of paper in a sheet transport path of a sheet fed rotary printing press. The sheets of paper are passed along a sheet feeding table and move between spaced light transmitters which may be laser diodes. The light reflected off the surface of the sheet or sheets has an angle with respect to a receiver which depends on the distance of the sheet or sheets from the light transmitter. By analyzing output voltages from receivers placed both above and below the sheet or sheets, a value corresponding to the thickness of the sheet or sheets can be ascertained. A thickness valve outside of a certain range is an indication of the superimposition of two or more sheets.

DESCRIPTION OF THE PRIOR ART

In sheet fed printing machines, a plurality of individual sheets are typically fed along a path of travel through various printing, drying, arranging and other handling and processing stations or areas. It is imperative that the sheets be positioned one after each other and that they not be overlapped or superimposed. If two or more sheets do become overlapped or superimposed the subsequent operation performed on the several sheets will quite probably not be performed correctly. Thus it is important that any overlapping or superimposition of sheets be detected and corrected.

One device which is useable to control overlapped sheets is disclosed in U.S. Pat. No. 4,397,460. In this device, the sheets on a sheet transport way are checked to see whether or not they are overlapped or superimposed. This is accomplished by providing two sequentially arranged sensor sensor devices positioned above the sheet transport way and two sequentially arranged sensor devices positioned beneath the sheet transport way or path. Each of these four sensor devices consists of a light emitting diode and of a phototransistor sensor which receives the light emitted from the diode and reflected from a surface of the sheet.

In the device for the control of overlapping sheets as set forth in U.S. Pat. No. 4,397,460 it is necessary that the sheets to be measured be guided essentially absolutely parallel to the transport way or path in the measuring range of the sequentially arranged sensor devices. This is accomplished by providing vacuum devices that feed the sheets against a surface whose location and position has previously been determined. In addition, in the prior art sheet control device of this patent, the degree of light reflection is measured and is thus dependant on the intensity of the reflection. This means that an accurate measurement can only be accomplished on a surface having a uniform degree or amount of reflection. This means that a measurement within a printed surface that may have been printed with several colors having differing intensities of reflection is not possible.

It will thus be apparent that a need exists for a method and apparatus for detecting superimposed sheets of paper which overcomes the limitations of the prior art. The assembly for detecting superimposed sheets in accordance with the present invention provides such a method and apparatus and is a substantial improvement over prior art devices.

SUMMARY OF THE INVENTION

It is an object of the present invention to provide a method and apparatus for detecting superimposed sheets.

Another object of the present invention is to provide a method and apparatus for detecting superimposed sheets on a sheet transport path.

A further object of the present invention is to provide a method and apparatus for detecting superimposed sheets on a sheet transport path of a sheet fed rotary printing press.

Yet another object of the present invention is to provide a method and apparatus for detecting superimposed sheets which is independent from the degree of reflection of the surface of the sheet.

Still a further object of the present invention is to provide a method and apparatus for detecting superimposed sheets which compensates for decreasing radiant intensity.

As will be set forth in detail in the description of the preferred embodiment which is presented subsequently, the method and apparatus for detecting superimposed sheets in accordance with the present invention utilizes transmitters and cooperating spaced receivers which are positioned both above and beneath the sheet transport way. Each transmitter is preferably a laser diode which directs a light against a surface of the sheet. The receiver is preferably a uniaxial position sensitive diode operator which supplies an analog signal dependant on the intensity distribution of light along its longitudinal axis. The output of the position sensitive diode operator is useable both to control the intensity of the laser diode transmitter and to measure the distance from the sheet which is reflecting the signal from the laser diode transmitter. By providing similar receivers that measure the distances to both the top and bottom surfaces of the sheet, a value representative of the thickness of the sheet can be obtained. This actual value is compared with a previously obtained nominal value. Too great a difference in the two values will result in the generation of a signal indicating a superimposed sheet situation.

A principal advantage of the present invention lies in its ability to be positioned at any point or points along the path of sheet transport. The overlapping or superimposition of the sheets can be sensed generally independently of the distance from the sheet surfaces to the sensor. This makes the present invention much more versatile than the prior art devices.

The sheet superimposition valuation accomplished by the subject invention is done using a simple and clear connection between the receiving unit and an assembly which stores previously ascertained nominal values In addition, the present invention provides a device which compensates for decreasing radiant intensity.

It will be seen that the method and apparatus for detecting superimposed sheets in accordance with the present invention overcomes the limitation of the prior art. It is accordingly a significant advance in the art.

BRIEF DESCRIPTION OF THE DRAWINGS

While the novel features of the method and apparatus for detecting superimposed sheets of paper in accordance with the present invention are set forth with particularity in the appended claims, a full and complete understanding of the invention may be had by referring to the detailed description of preferred embodiments which is presented subsequently, and as shown in the accompanying drawings in which:

DESCRIPTION OF THE PREFERRED EMBODIMENTS

Figure 1:
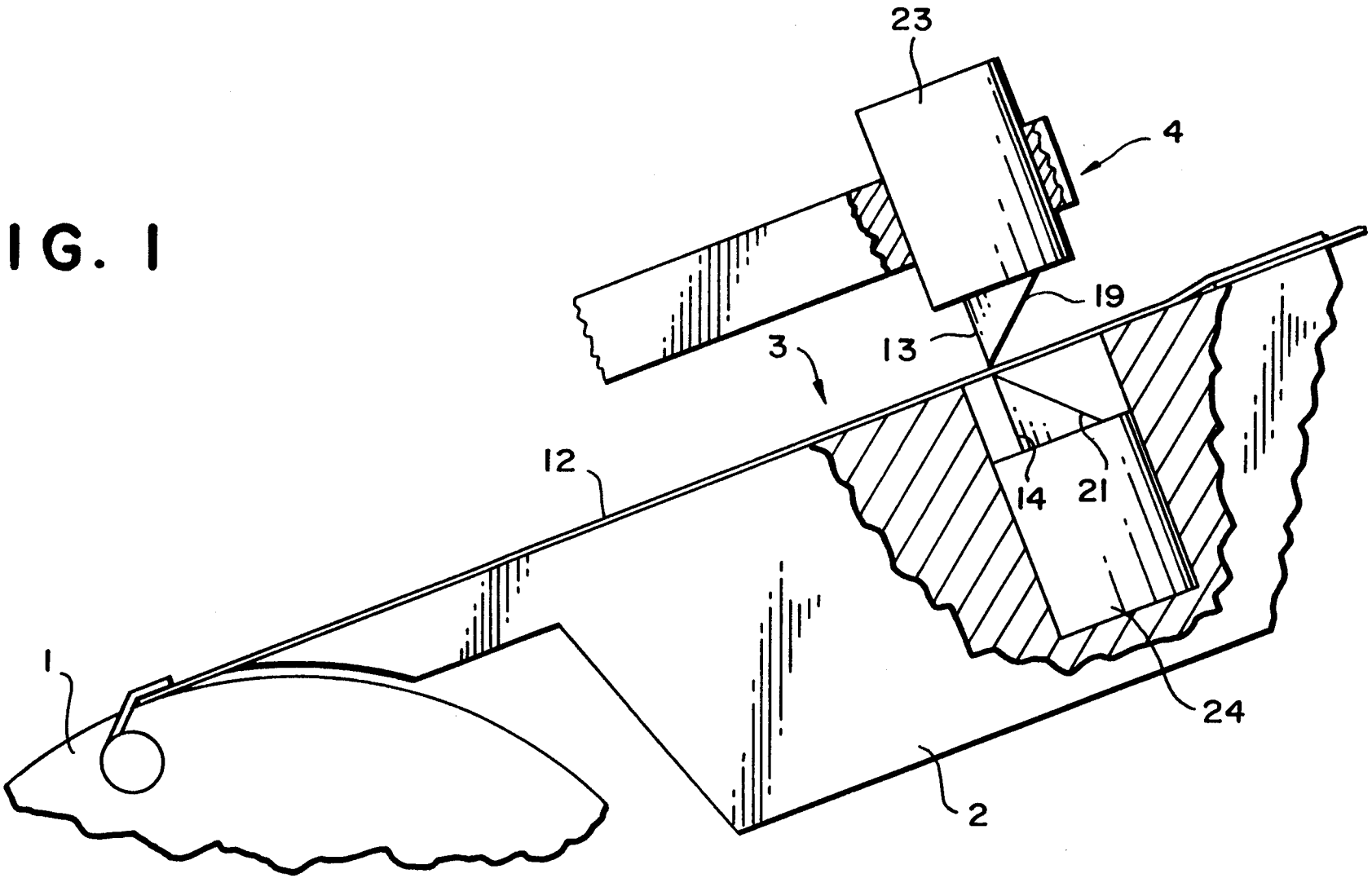
FIG. 1 is a schematic side elevation view of a sheet feeding table of a rotary printing press utilizing the method and apparatus for detecting superimposed sheets of paper in accordance with the present invention.

Referring initially to FIG. 1, there may be seen a sheet fed rotary printing press utilizing the method and apparatus for detecting superimposed sheets of paper in accordance with the present invention. The sheet fed rotary printing press shown in FIG. 1 has, among other features, a stop drum 1 and a sheet feeding table 2 with a sheet transport way 3. In a section of the sheet transport way 3, there is provided a controlling device 4 for the control of overlapped sheets. The controlling device 4 has among other through a first transmitter 6 and receiver 7, arranged above the transport way 3 in a housing 23, as well as a second transmitter 8 and receiver 9, arranged in a housing 24 under the transport way 3. These transmitters 6 and 8, and receivers 7 and 9 may be seen most clearly in FIGS. 2 and 3. The housings 23 and 24 are not shown in FIGS. 2 and 3 but are shown in FIG. 1.

The control device 4, and especially the receivers 7 and 9 thereof, are connected with each other by means of an evaluation connection 11, which links, at its output end, two analog voltages $V_7$ and $V_9$ with each other and compares them with a previously stored nominal value. Each of the two voltage signals $V_7$ and $V_9$ is proportional to the distance of a target 12, such as a sheet, from the respective receivers 7 or 9. The evaluation connection 11 is shown in detail in FIG. 4 and will be discussed in detail subsequently.

Figure 2:
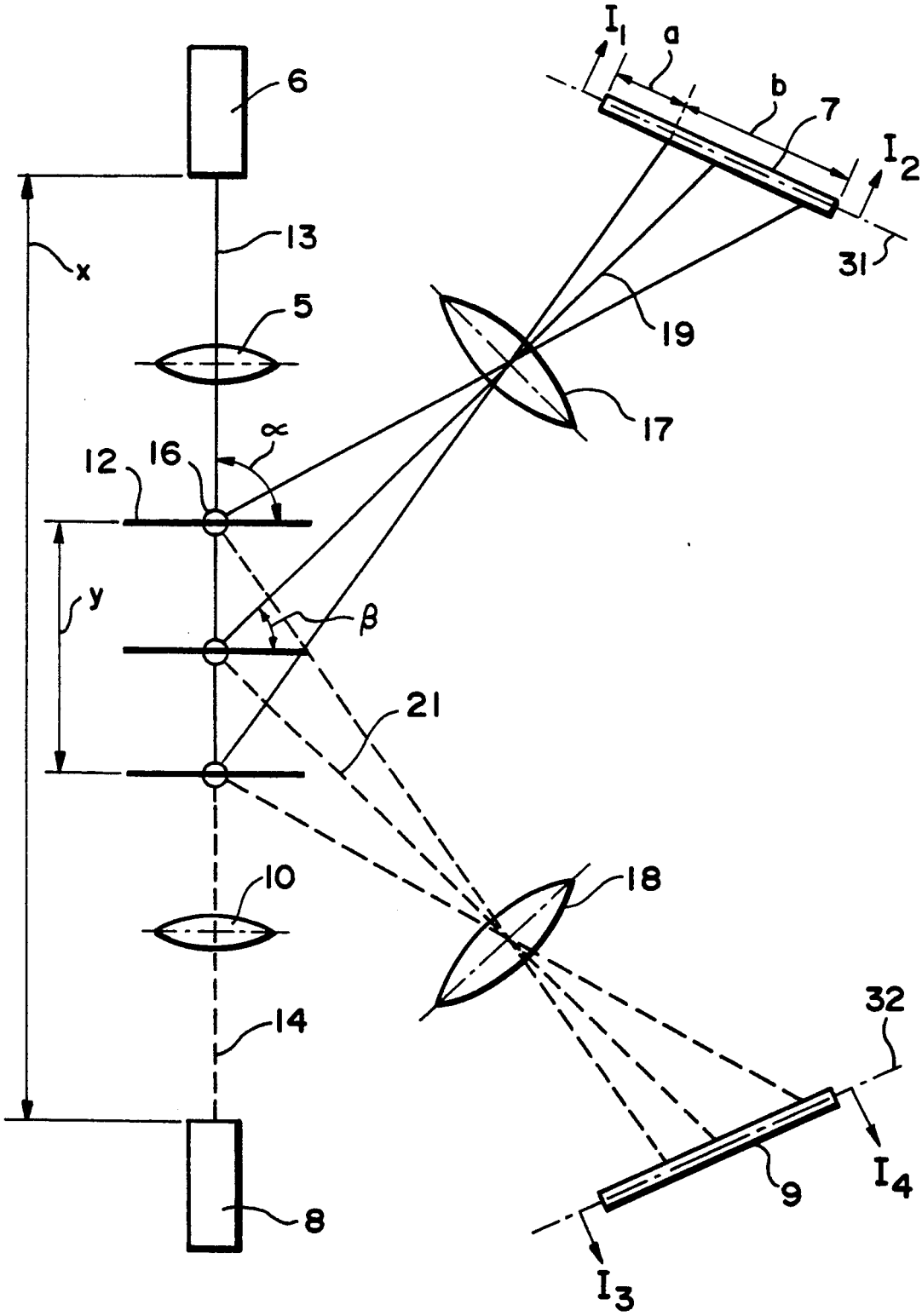
FIG. 2 is a schematic depiction of the apparatus of the present invention and showing a first preferred embodiment of the path of the light rays.

The arrangement of the transmitters 6 and 8 in the first embodiment is executed as may be seen in FIG. 2, so that both transmitters 6 and 8 are facing each other at a double working distance $\times$ which may be, for example $2\times 40$ mm $=80$ mm, and the sheet 12 to be scanned is passing at an angle $\alpha$ of approximately 40° to 130° through a light ray 13 or 14, generated by a transmitter 6 or 8. As will be discussed shortly, the transmitters 6 and 8 are preferably laser diodes that thus generate a coherent laser beam or light ray 13 or 14 through which the sheet 12 passes.

The controlling device 4 in accordance with the present invention operates according to the optical principle of the triangulation method. This method is based on the fact that an object, such as a gauge spot 16, which is positioned in front of an objective lens 17 or 18, yields behind the objective lens a reversed real image. When the object 16 is positioned a certain distance from the optical axis 19 or 21, it is sharply projected in the image distance. In case the position of the object 16 is changing, the position of the image is changing vertically and parallely in relation to the optical axis 19 or 21.

Each transmitter 6 and 8 is preferably a pulsed laser diode. The laser diode 6 or 8 projects a corresponding light spot or gauge spot 16 on the sheet 12 to be measured. The paper thickness of sheet 12 can be measured within a working range of y such as $+/-$ 10 mm. During the measurement operation, the sheet 12 can move into any position. A convex lens 5 or 10 prevents an overly high expansion of the light ray 13 or 14. With a measuring range y of about $+/-10$ mm around the center distance of 40 mm, the measurement is effected in the convergent path of the rays of the laser. For this reason, there is obtained a light spot, diminishing with increasing measuring distance. When a focal distance of 80 mm is exceeded, the laser ray diverges and so experiences in a distance of 74 cm such a big expansion, that there is no longer a danger for the human eye, because of the decreasing illuminating power resulting from this. The NOHO-valve (Normal Optical Hazard Distance) of the laser transmitter 6 or 8 is thus 74 cm.

The laser ray 13 or 14 passes parallely in relation to the transmitter axis, so that during a a changing measuring distance to the sheet 12, the light spot 16 always has the same position on the sheet 12. The optical receiving unit 7 or 9 is arranged at a suitable angle $\beta$ of about 40° to 130° in relation to the transmitting ray 13 or 14, which projects the light spot 16 on the photoreceiver 7 or 9. When the sheet 12 moves vertically along the transmitting ray 13 or 14, the location of the reflected light on the photo-receiver 7 or 9 also moves, because of this angle $\beta$. The arrangement angles $\alpha$ and $\beta$ should be chosen so, that $\alpha$ is not equal to $\beta$.

Each receiver 7 and 9 is a uniaxial PSD or position sensitive diode-operator. A PSD-operator is a photoreceiver 7 or 9, whose output, in dependence on the light intensity distribution along its longitudinal axis 31 or 32, is analog signals $I_1$ and $I_2$ or $I_3$ and $I_4$. These output analog signals depend on the position of the reflected ray. The function becomes clear by comparison with a potentiometer. The proportion of the two output currents $I_1$ and $I_2$ or $I_3$ and $I_4$ is reversed proportional to the relation of the paths a and b, which are determined by the position of the light spot on the receivers 7 or 9. The sum $\Sigma$ of the currents $I_1$ and $I_2$ is equivalent to the light intensity Io of the light spot. The photoreceivers 7 and 9 each supplies a current $I_o$ depending on the emitted illuminating power. This so-called monitor current $I_o$ regulates the illuminating power of the laser diode 6 or 8 to 2 mW. This compensates for any drift of the laser and thus there is guaranteed a constant light emission in the working temperature range of 0°-50° C. of the apparatus in accordance with the present invention.

The sum $\Sigma$ of the currents $I_1$ and $I_2$ is also a measure for the luminance factor of the measured object 16. This value also intervenes in the luminous flux regulation of the laser diode or transmitter 6 or 8 and assures that the receiver 7 or 9 is always exposed with a same intensity, independent of the object's color and surface. By this, there is avoided an under-or overexposure of the photoreceiver 7 or 9 through a wide range.

The resolution is determined substantially by the noise and the temperature coefficient of the PSD-receiver 7 or 9, and by image distortions of the optics 17 and 18. Since the light spot 16 and its projection have a finite extent, there occurs, depending on the color and the kind of surface of the target 12, a non-homogeneous projection of the light spot 16. When passing from a black to a white area, the light spot 16 will have a higher intensity in the white area than in the black area. So, it is not homogeneous. Depending on the roughness grade of the surface of the sheet 12, there can also occur shadows in the projection of the light spot 16. In this case as well, the projection of the light spot 16 at the receiver 7 or 9 is not homogeneous. As the surface center of the energy distribution on the photo-receiver 7 or 9 is determined by the evaluation connection 11, there occurs in the above examples in consequences of an uneven projection of the light spot 16, an influence of the measured value. The linearity of the evaluation connection 11 is obtained by a characteristic curve of the PSD-operator and by the optical distortion of the projection of the light spot. For this reason, the same is corrected by a non-linear amplifier 41 or 42. These non-linear amplifiers are depicted schematically in FIG. 4.

Both photo-receivers 7 and 9 measure simultaneously the distance to the sheet 12 and both supply an analog voltage $V_7$ or $V_9$ which is proportional to the distance from the gauge spot 16 to the photo-receiver 7 or 9. The two analog signals $V_7$ and $V_9$ are digitized by means of an input card 26 and supplied to a computer unit 27, as is depicted schematically in FIG. 4. It will be understood that the input card 26 is representative of any known device which will covert an analog signal to a digital signal that is understandable by the computer unit 27. The computer unit 27 determines from the analog voltages $V_7$ and $V_9$ the paper thickness and compares the value with a nominal paper thickness value that was stored during a prior "Learn"-cycle. During the "Learn"-cycle, a single sheet 12 is led over the sheet transport way 3 and the paper thickness is measured by means of the controlling device 4. This paper thickness value is then stored as the nominal value in the memory of the computer 27. It is, of course, also possible to put the nominal value into the computer 27 by means of a key board. In case the measured paper thickness value diverges from the nominal measured value, beyond previously established limits, the computer unit then signals that overlapped sheets are existing.

Referring again to FIG. 2, it will be seen that the arrangement of the laser transmitters 6 and 8 is executed so that the two laser rays 13 and 14 have an angle of incidence $\alpha$ of 90° on the paper 12. By this, the laser-overlapped sheet control is able to control a wide range of paper thicknesses such as from 40 g to 500 g. The advantage of the laser-overlapped sheet control lies in that very thin or transparent sheets as well as very thick paper or cardboard can be controlled at the feeder, previous to the pull lay, for overlapped sheets. In case there are utilized, for example, advance sheets having the same paper weight as those to be utilized for the current order, the measuring method of the present invention does not make any difference for printed or blank paper. External influences such as temperature, air humidity, daylight, ambient light or shocks also do not have any influence on the measuring result.

Figure 3:
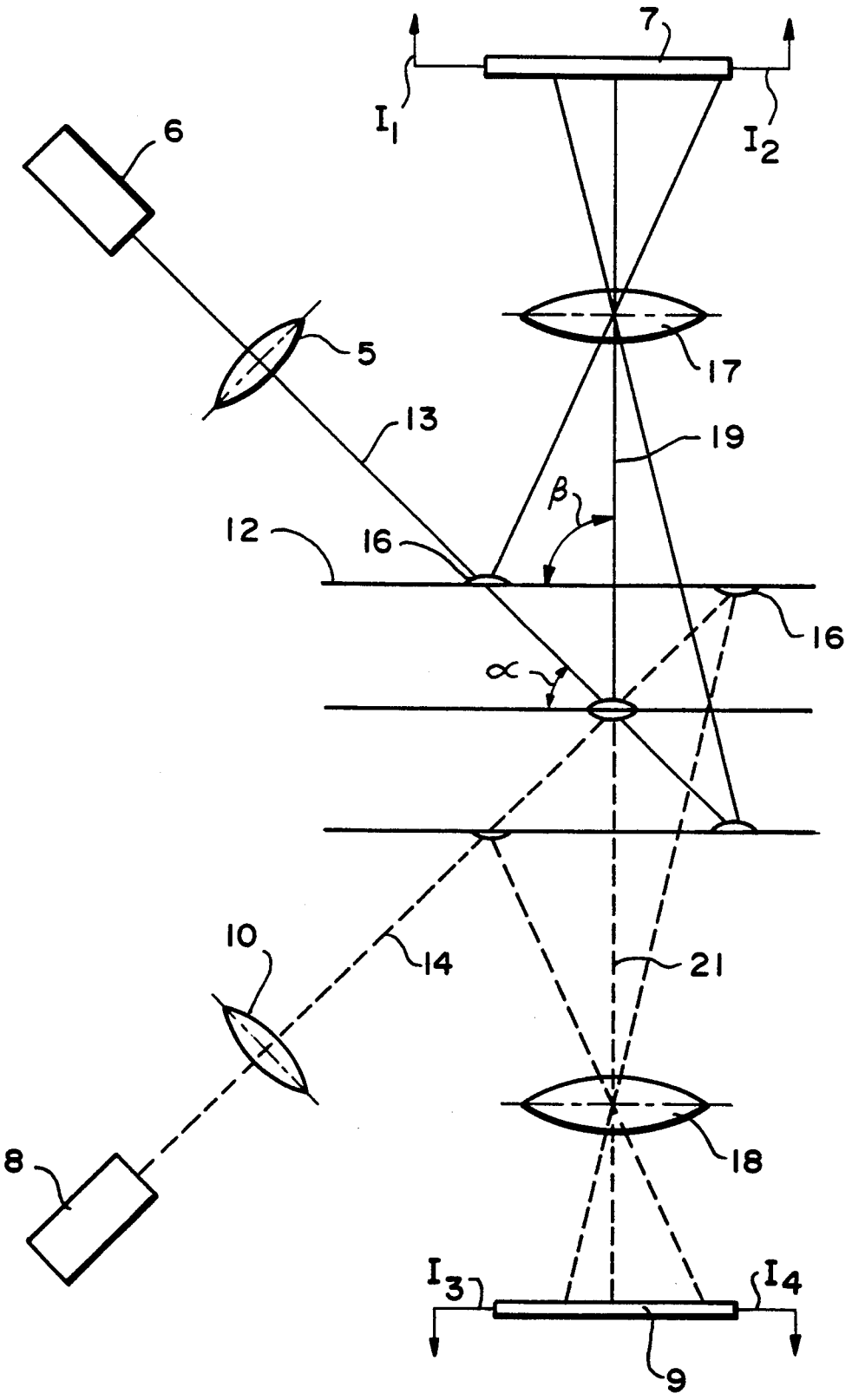
FIG. 3 is a schematic depiction of the apparatus and showing a second preferred embodiment of the path of the light rays.

Turning now to FIG. 3, there may be seen a second preferred embodiment of a method and apparatus for detecting superimposed sheets of paper in accordance with the present invention. In this second embodiment shown in FIG. 3, each of the transmitters 6 and 8 is positioned in such a way with respect to the sheet surface 12 that the laser rays 13 and 14 impact the sheet surface at an angle $\alpha$ o of approximately 45°. In this case, the light spot 16 adopts an elliptic form with a varyingly enlarged surface area such as approximately $0.8\times0.4$ mm at 30 mm distance; $0.4\times0.2$ mm at 50 mm distance; or $0.6\times0.3$ mm at 40 mm distance; and with a similarly varying illuminating intensity. The optical axis 19 or 21 of the reflected ray is arranged in this case rectangularly in relation to the sheet surface or the sheet transport way 3.

Figure 4:
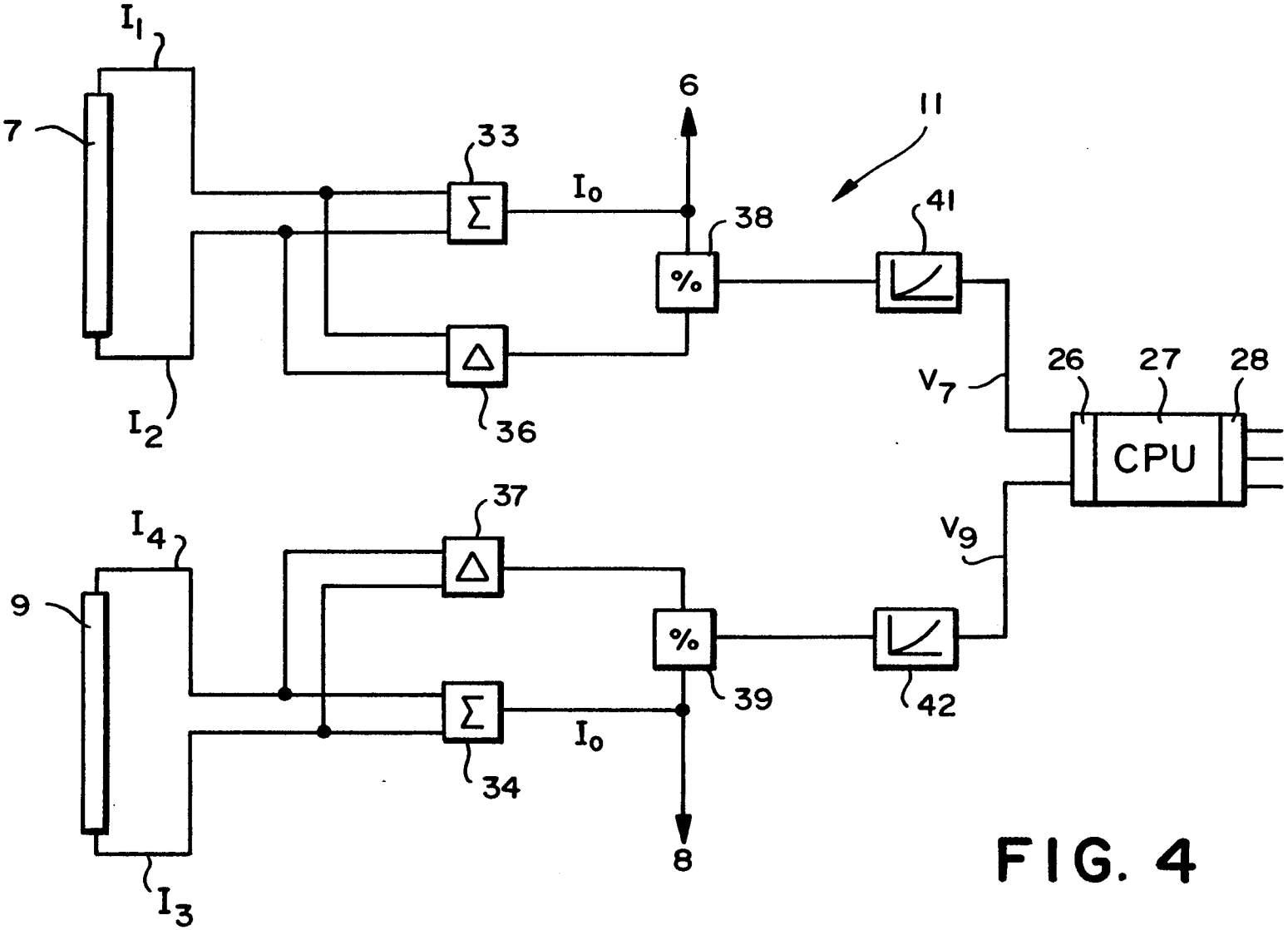
FIG. 4 is a schematic depiction of the evaluation connection of the present invention.

As has been discussed briefly, FIG. 4 shows the evaluation connection 11 for the currents $I_1$, $I_2$, $I_3$ and $I_4$. The currents $I_1$ and $I_2$ from the first receiver 7 are led to a first adding evaluating operator 33 and the currents $I_3$ and $I_4$ from the second receiver 9 are led to a second adding evaluating operator 34. Simultaneously, the currents $I_1$ and $I_2$ are led to a first difference evaluating operator 36 and the currents $I_3$ and $I_4$ are led to a second difference evaluating operator 37. In each of the first or second difference evaluating operators 36 and 37, the current $I_2$ is subtracted from the current $I_1$ or the current $I_4$ is subtracted from the current $I_3$.

$$\Sigma_{33} = I_1 + I_2 \quad \Sigma_{34} = I_3 + I_4$$
$$\Delta_{36} = I_1 - I_2 \quad \Delta_{37} = I_3 - I_4$$

The current values from the first adding evaluating operator 33 and the first difference evaluating operator are then fed to a first divider operator 38. In a similar manner, the current values from the second adding evaluating operator 34 and the second difference evaluating operator 37 are fed to a second divider operator 39. Each of the first and second divider operators 38 and 39 divides the sum of the currents $I_1+I_2$ or $I_3+I_4$ by the differences of the currents $I_1-I_2$ or $I_3-I_4$. Each of the resulting values is then led to the first or second cooperating non-linear amplifier 41 or 42. From there, they come as the comparison voltages $V_7$ and $V_9$ to the input card 26 of the computer 27. At the computer 27 these actual voltages $V_7$ and $V_9$, which are useable to ascertain the actual thickness of the sheet 12, are compared to the nominal value of the paper thickness that has been previously entered into the computer 27. If the actual and the nominal thickness values diverge considerably from each other so that this divergence exceeds a previously selected limit, such as, for example if the actual value is more than 1.8 times as great as the nominal value, a signal is generated. This signal may be generated using a suitable output card 28 which gives an indication that an overlapping sheet condition exists. This signal can be used to accomplish the immediate stop of the sheet transport and can also generate suitable optical and/or acoustical signals. As a result of the stopping of sheet transport and the generation of suitable signals, the press operator can rectify the overlapping or superimposed sheet condition and can take the appropriate action to prevent its recurrence.

While preferred embodiments of a method and apparatus for detecting superimposed sheets of paper in accordance with the present invention have been set forth fully and completely hereinabove, it will be apparent to one of skill in the art that a number of changes in, for example, the sizes of the sheets being fed, the type of sheet feeding table, the size of the stop drum and the like can be made without departing from the true spirit and scope of the subject invention which is accordingly to be limited only by the following claims.

What is claimed is:

1. A method for detecting superimposed sheets along a sheet transport way, comprising:

positioning a first light transmitter on a first side of said sheet transport way and focusing first light rays from said first transmitter onto a light spot on first surfaces of sheets positioned on said transport way;

positioning a second light transmitter on a second side of said sheet transport way and focusing second light rays from said second transmitter onto a light spot on second surfaces of sheets positioned on said transport way;

receiving at a first position-sensitive light receiver located on said first side of said sheet transport way first light rays reflected from the light spot on first surfaces of sheets positioned on said transport way, the position of incidence of said reflected light rays on said first receiver being dependent upon the distance between said light spot on said first surfaces and said first receiver;

generating at said first receiver first and second analog signals whose values are proportional to the position of incidence of the light rays reflected from said first light spot on said first receiver;

summing said first and second signals to produce first sum signals to measure and control the luminance of said first light transmitter;

receiving at a second position-sensitive light receiver located on said second side of said sheet transport way second light rays reflected from the light spot on second surfaces of sheets positioned on said transport way, the position of incidence of said reflected light rays on said second receiver being dependent upon the distance between said light spot on said second surfaces and said second receiver;

generating at said second receiver third and fourth analog signals whose values are proportional to the position of incidence of the light rays reflected from said second light spot on said second receiver;

summing said third and fourth signals to produce second sum signals to measure and control the luminance of said second light transmitter;

subtracting said first and second signals to produce first difference signals;

subtracting said third and fourth signals to produce second difference signals;

dividing said first sum signals by said first difference signals to produce first evaluation signals for the first surface of said sheets;

compensating said first evaluation signals for inhomogeneities in said first surfaces of said sheets to produce a first surface analog position signal;

dividing said second sum signals by said second difference signals to produce second evaluation signals for the second surface of said sheets;

compensating said second evaluation signals for inhomogeneities in said second surface of said sheets to produce a second surface analog position signal;

comparing said first surface position signal to said second surface position signal to obtain a sheet thickness value signal; and comparing said sheet thickness value to a predetermined nominal thickness value to detect the presence of superimposed sheets.

2. Apparatus for detecting superimposed sheets along a sheet transport way, comprising:

first and second light transmitter producing first and second light rays, respectively, said first transmitter being located on a first side of a sheet transport way and said second transmitter being located on a second side of said sheet transport way;

first and second focusing means for focusing said first and second rays, respectively, onto light spots on corresponding first and second surfaces of sheets on said sheet transport way;

first and second position-sensitive light receivers located on said first and second sides of said transport ways, respectively, to receive light rays reflected from the light spots on corresponding first and second surfaces of sheets positioned on said transport way, the position of incidence of reflected light rays on each said receiver being dependent upon the distance between said receivers and their correspondence light spots on the sheet surfaces, said receives each generating first and second analog output surfaces whose values are proportional to the position of incidence of the light rays reflected from corresponding light spots on said corresponding first and second surfaces of sheets on said transport way;

first and second summing means for receiving and summing said output signals of each of said first and second receivers, respectively, to produce first and second sum signals for controlling the luminance of said first and second light transmitters, respectively;

first and second subtraction means for receiving and subtracting the first and second output signals of said first and second receivers, respectively, to produce first and second difference signals;

first divider means dividing said first sum signals by said first difference signals to produce first surface position signals for the first surface of sheets on said transport way;

second divider means dividing said second sum signal by said second difference signal to produce second surface position signals for the second surface of sheets on said transport way.

first and second compensation means for said first and second surface position signals, respectively, to compensate for inhomogeneities in corresponding first and second surfaces of sheets on said transport way;

means comparing said compensated first and second surface position surfaces to obtain a sheet thickness value; and means comparing said sheet thickness value with a predetermined value to detect superimposed sheets on said transport way.

* * * * *

UNITED STATES PATENT AND TRADEMARK OFFICE

CERTIFICATE OF CORRECTION

PATENT NO. : 5,222,729

DATED : June 29, 1993

INVENTOR(S) : Horst H. Wallaschkowski

It is certified that error appears in the above-identified patent and that said Letters Patent is hereby corrected as shown below:

Column 8, line 2, after the word "second" the word "surface" should be --surfaces--;
line 29, before the word "light" the word "correspondence" should be --corresponding--;
line 30, after the word "said" the word "receives" should be --receivers--;
line 53, after the word "second" the word "surface" should be --surfaces--; and
line 60, after the word "position" the word "surfaces" should be --signals--.

Signed and Sealed this

Twenty-second Day of March, 1994

*Attest:*

Bruce Lehman

BRUCE LEHMAN

*Attesting Officer*

*Commissioner of Patents and Trademarks*